US011976537B2

(12) United States Patent
Seczon

(10) Patent No.: US 11,976,537 B2
(45) Date of Patent: May 7, 2024

(54) DOWNHOLE WELLBORE SYSTEMS FOR GENERATING ELECTRICITY

(71) Applicant: Luis Seczon, Fulshear, TX (US)

(72) Inventor: Luis Seczon, Fulshear, TX (US)

(73) Assignee: Oilfield Equipment Development Center Limited, Victoria (SC)

( * ) Notice: Subject to any disclaimer, the term of this patent is extended or adjusted under 35 U.S.C. 154(b) by 21 days.

(21) Appl. No.: 17/685,256

(22) Filed: Mar. 2, 2022

(65) Prior Publication Data

US 2023/0279747 A1 Sep. 7, 2023

(51) Int. Cl.
*E21B 41/00* (2006.01)
*E21B 33/12* (2006.01)

(52) U.S. Cl.
CPC ..... *E21B 41/0085* (2013.01); *E21B 33/12* (2013.01)

(58) Field of Classification Search
CPC ..... E21B 41/0085
See application file for complete search history.

(56) References Cited

U.S. PATENT DOCUMENTS 4,132,269 A * 1/1979 Chasteen ..... E21B 41/0085 166/305.1
4,248,305 A 2/1981 Scarbrough et al.
4,282,444 A 8/1981 Ramer
4,813,481 A * 3/1989 Sproul ..... E21B 43/045 166/325
5,285,204 A 2/1994 Sas-Jaworsky
5,839,508 A 11/1998 Tubel et al.
6,848,503 B2 * 2/2005 Schultz ..... F03B 13/00 310/156.01
7,002,261 B2 * 2/2006 Cousins ..... H02P 6/15 290/43
9,518,448 B2 * 12/2016 Read ..... E21B 41/0085
2004/0085223 A1 * 5/2004 Winnacker ..... E21B 41/0085 310/90.5
2005/0012340 A1 * 1/2005 Cousins ..... E21B 41/0085 290/52

(Continued)

FOREIGN PATENT DOCUMENTS

WO WO2017023317 A1 2/2017
WO WO2021015624 A1 1/2021

*Primary Examiner* — Steven A MacDonald
(74) *Attorney, Agent, or Firm* — Elliott Law PLLC; Douglas H. Elliott; Nathan Q. Huynh

(57) ABSTRACT

Disclosed herein are downhole generator assemblies and methods for generating electricity that may each include a downhole generator assembly which may include: an upper perforation capable of receiving reservoir fluid therethrough; and a lower perforation capable of receiving reservoir fluid therethrough; an annular barrier disposed in the interior of the first conduit below the upper perforation and above the lower perforation and capable of inhibiting reservoir fluid from flowing past the annular barrier; a second conduit in the wellbore, the second conduit having an interior and an upper port; a housing coupled to the second conduit, the housing having an interior and an lower port; an impeller disposed in the housing, wherein the impeller may be capable of being rotated by moving fluid flowing in the interior of the housing; and a generator disposed outside the housing, the generator comprising a rotor coupled to the impeller.

7 Claims, 7 Drawing Sheets

(56) References Cited

U.S. PATENT DOCUMENTS

| | | | | |
|---|---|---|---|---|
| 2008/0271923 | A1* | 11/2008 | Kusko | E21B 41/0085 175/25 |
| 2010/0071910 | A1* | 3/2010 | Ellson | E21B 17/003 166/250.01 |
| 2011/0233937 | A1 | 9/2011 | Riley | |
| 2014/0069724 | A1* | 3/2014 | Amsellem | F16D 51/40 415/33 |
| 2016/0341012 | A1* | 11/2016 | Riley | E21B 41/0085 |
| 2016/0348477 | A1* | 12/2016 | Ocalan | E21B 41/0085 |
| 2022/0333476 | A1* | 10/2022 | Hemb | C25B 9/17 |

* cited by examiner

DOWNHOLE WELLBORE SYSTEMS FOR GENERATING ELECTRICITY

BACKGROUND

1. Field of Inventions

The field of this application and any resulting patent is downhole wellbore systems for generating electricity and downhole methods for generating electricity.

2. Description of Related Art

Various downhole wellbore systems and methods for generating electricity in a wellbore have been proposed including prior art downhole generator assemblies listed on this patent. However, those systems and methods lack the combination of steps and/or features of the systems and methods claimed herein. Furthermore, it is contemplated that the systems and/or methods disclosed herein, including those claimed, solve at least some of the problems those prior art systems and methods have failed to solve. Also, it is contemplated that the systems and/or methods claimed herein have benefits that would be surprising and unexpected to a hypothetical person of ordinary skill with knowledge of the prior art existing as of the filing date of this application.

SUMMARY

The disclosure herein includes systems for generating electricity using reservoir fluid, and methods for generating electricity using those systems, which systems may include: a first conduit in a wellbore, the first conduit having an interior and including: an upper perforation capable of providing for the passage of reservoir fluid therethrough; and a lower perforation capable of providing for the passage of reservoir fluid therethrough; a second conduit in the wellbore, the second conduit having an interior and including an upper port capable of providing for the passage of reservoir fluid from the interior of the first conduit to the interior of the second conduit; an annular barrier disposed in the interior of the first conduit below the upper perforation and below the upper port of the second conduit and above the lower perforation, the annular barrier being capable of inhibiting reservoir fluid from flowing past the annular barrier; a housing coupled to the second conduit, the housing having an interior and including a lower port capable of providing for the passage of reservoir fluid from or to the interior of the housing; an impeller disposed in the housing, wherein the impeller may be capable of being rotated by moving fluid flowing within the interior of the second housing; and a generator disposed outside the housing, the generator including a rotor coupled to the impeller.

Additionally, the disclosure herein includes systems for generating electricity using reservoir fluid, and methods for generating electricity using those systems, which systems may include: a first conduit in a wellbore, the first conduit having an interior and including: an upper perforation capable of providing for the passage of reservoir fluid therethrough; and a lower perforation capable of providing for the passage of reservoir fluid therethrough; a second conduit in the wellbore, the second conduit having an interior and including an upper port capable of providing for the passage of reservoir fluid from the interior of the first conduit to the interior of the second conduit; an annular barrier disposed in the interior of the first conduit below the upper perforation and below the upper port of the second conduit and above the lower perforation, the annular barrier being capable of inhibiting reservoir fluid from flowing past the annular barrier; a first housing coupled to the second conduit, the first housing having an interior and including a lower port capable of providing for the passage of reservoir fluid from or to the interior of the first housing; a second housing disposed in the first housing; an impeller disposed in the second housing, wherein the impeller may be capable of being rotated by moving fluid flowing within the interior of the second housing; and a generator disposed outside the second housing and inside the first housing, the generator including a rotor coupled to the impeller.

Also, the disclosure herein includes systems for generating electricity using reservoir fluid, and methods for generating electricity using those systems, which systems may include: a first conduit in a wellbore that has an interior and includes: one or more upper perforations capable of providing for the passage of reservoir fluid therethrough; and one or more lower perforations capable of providing for the passage of reservoir fluid therethrough; an annular barrier disposed in the interior of the first conduit below the upper perforation and above the lower perforation and capable of inhibiting reservoir fluid from flowing past the annular barrier; a second conduit disposed inside the first conduit, the second conduit having an interior and one or more upper ports; an annular space between the first conduit and the second conduit, wherein: at least one of the one or more upper ports may be configured to provide for passage of reservoir fluid from the annular space into the interior of the second conduit and wherein the annular space may include a first annular space above the barrier and a second annular space below the barrier, and wherein the barrier may be capable of inhibiting the flow of fluid downward past the barrier from the first annular space to the second annular space; a housing coupled to the second conduit, the housing having a lower port; an impeller disposed in the housing; a generator disposed outside the housing, the generator including a rotor coupled to the impeller; and a cable capable of transmitting electricity upward through the wellbore to the surface.

In addition, the disclosure herein includes systems for generating electricity using reservoir fluid, and methods for generating electricity using those systems, which systems may include: a first conduit in a wellbore that has an interior and includes: one or more upper perforations capable of providing for the passage of reservoir fluid therethrough; and one or more lower perforations capable of providing for the passage of reservoir fluid therethrough; a barrier disposed in the interior of the first conduit below the upper perforation and above the lower perforation and capable of inhibiting reservoir fluid from flowing past the barrier; a second conduit disposed inside the first conduit, the second conduit having an interior and one or more upper ports; a cylindrical housing coupled to the second conduit, wherein the housing may have a cylindrical wall, an interior portion, an upper end opening, and a lower end opening; a third conduit extending from the lower end opening of the cylindrical housing into the barrier; a barrier below the at least one of the one or more upper ports, wherein the annular barrier may be disposed around the third conduit, and may be capable of inhibiting the flow of fluid past the barrier; an impeller disposed in the housing; a generator disposed in the interior of the cylindrical housing, the generator including a rotor coupled to the impeller; and a cable capable of transmitting electricity upward through the wellbore to the surface.

Furthermore, the disclosure herein includes methods of generating electricity using any of the systems disclosed herein, which methods may include: providing a downhole wellbore system into a wellbore, which downhole wellbore system may include: a first conduit in a wellbore that has an interior and may include: one or more upper perforations capable of providing for the passage of reservoir fluid therethrough; and one or more lower perforations capable of providing for the passage of reservoir fluid therethrough; an annular barrier disposed in the interior of the first conduit below the upper perforation and above the lower perforation and capable of inhibiting reservoir fluid from flowing past the annular barrier; a second conduit disposed inside the first conduit, the second conduit having an interior and one or more upper ports; an annular space between the first conduit and the second conduit; a housing coupled to the second conduit, the housing having a lower port; an impeller disposed in the housing; a generator disposed outside the housing, the generator may include a stator, a rotor coupled to the impeller, and a magnet coupled to the rotor; and a cable coupled to the generator; causing reservoir fluid to flow through the upper port through the conduit into the turbine; rotating the impeller with reservoir fluid flowing through the turbine, and out through the lower port, wherein the magnet may also be rotated relative to the stator; and generating electricity when the magnet is rotated.

Moreover, the disclosure herein includes methods of generating electricity using reservoir fluid, which methods may include: providing a downhole wellbore system into the wellbore, which downhole wellbore system may include: a first conduit in a wellbore that has an interior and may include: one or more upper perforations capable of providing for the passage of reservoir fluid therethrough; and one or more lower perforations capable of providing for the passage of reservoir fluid therethrough; a barrier disposed in the interior of the first conduit below the upper perforation and above the lower perforation and capable of inhibiting reservoir fluid from flowing past the barrier; a second conduit disposed inside the first conduit, the second conduit having an interior and one or more upper ports; a cylindrical housing coupled to the second conduit, wherein the housing may have a cylindrical wall, an interior portion, an upper end opening, and a lower end opening; a third conduit extending from the lower end opening of the cylindrical housing into the barrier; a barrier below the at least one of the one or more upper ports, wherein the annular barrier may be disposed around the third conduit; an impeller disposed in the housing; a generator disposed in the interior of the cylindrical housing, the generator may include stator, a magnet, and a rotor coupled to the impeller; and is capable of inhibiting the flow of fluid past the barrier; causing reservoir fluid to flow through the upper port through the second conduit and into the housing; causing reservoir fluid to flow through the housing; rotating the impeller with reservoir fluid flowing through the housing and out of the exit port, wherein the magnet may also be rotated relative to the stator; and generating electricity when the magnet is rotated.

DETAILED DESCRIPTION

1. Introduction

Figure 1A:
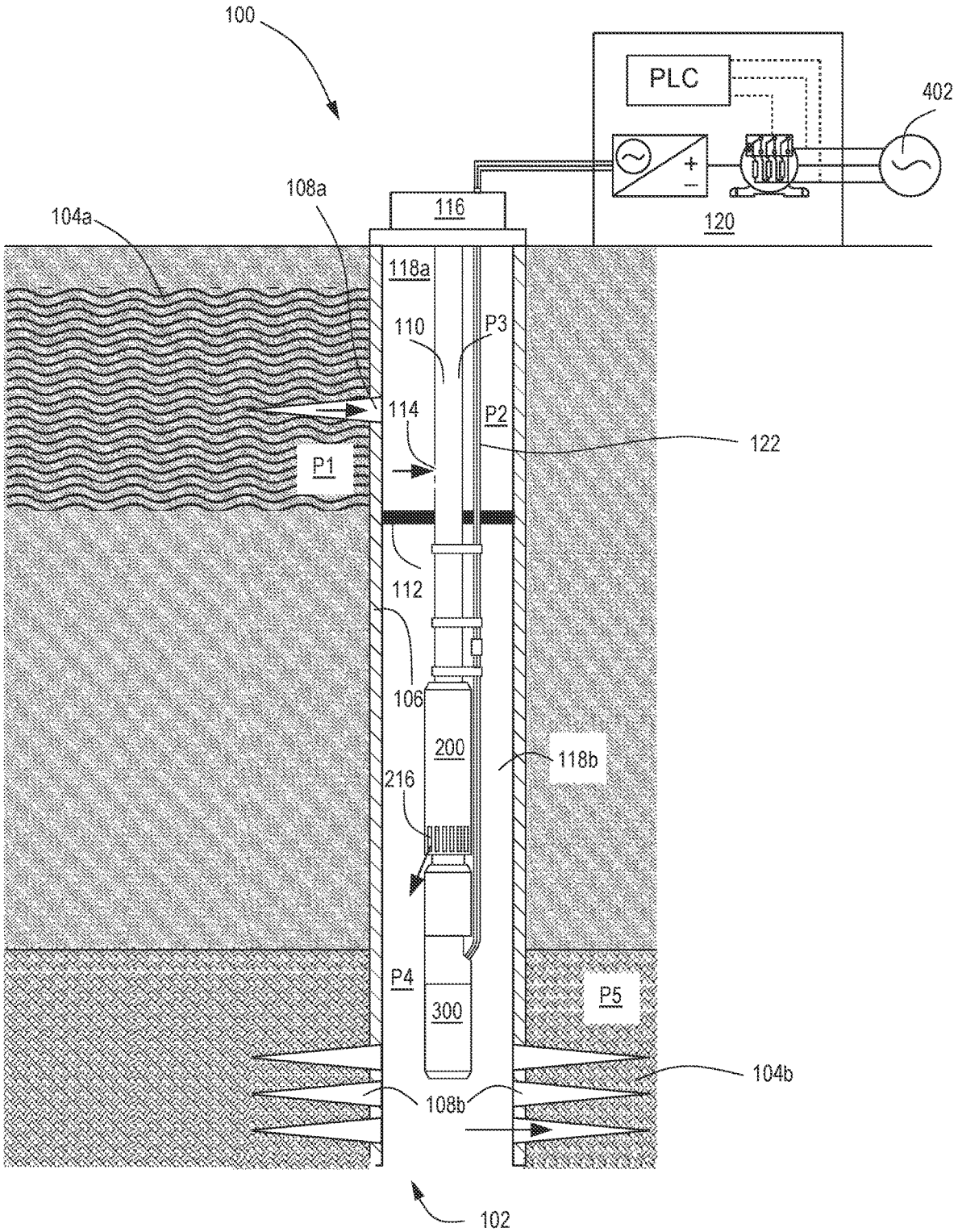
FIG. 1A is a schematic drawing that illustrates an example of a downhole wellbore system for generating electricity.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The terms "annular barrier" and "barrier" mean any structure that when disposed in a wellbore, e.g., an annular space within a wellbore, is capable of preventing, inhibiting, or impeding the passage of fluid, e.g., reservoir water, past the structure from one part of the wellbore, e.g., one part of the annular space (e.g., above the structure) to another part of the wellbore, e.g., another part of the annular space (e.g., below the structure). At least one non-limiting example of an annular barrier is a seal which is preferably a packer. A "seal" is defined as an annular barrier that when disposed in an annular space has sealing contact with the surfaces forming the annular space and thus provides a seal that helps in the prevention of fluid passing past the seal from one part of the annular space (e.g., a first annular space) to another part of the annular space (e.g., a second annular space). At least one non-limiting example of a seal is a packer.

The term "annular space" means any space having an annular form, e.g., the cylindrical space between the inside surface of the wall of an outer conduit, e.g., the "first conduit," e.g., the casing illustrated in FIG. 1A, and the outside surface of the wall of an inner conduit, e.g., the "second conduit" illustrated in FIG. 1A, e.g., the tubular. As discussed below, an annular space may also include multiple annular spaces, e.g., a first annular space, which may also be referred to as an upper annular space, and a second annular space, which may also be referred to as a lower annular space.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., a groove. An aperture can be an opening in an object that is completely circumscribed, defined, or delimited by the object itself. Alternatively, an aperture can be an opening in the object formed when the object is combined with one or more other objects or structures. One or more apertures may be disposed and pass entirely through a casing, a conduit, and/or a turbine. An aperture may receive another object and permit ingress and/or egress of the object through the aperture. Non-limiting examples of apertures herein are perforations, entry ports, and exit ports.

The term "assembly" as used herein is defined as any set of components that have been fully or partially assembled together. A group of assemblies may be coupled to form a combined assembly, e.g., a body having an inner surface and an outer surface.

The term "axis" as used herein is defined as any actual or imaginary line running through the center of an object or structure.

The term "coupled" as used herein is defined as directly or indirectly connected, attached, or integral with, e.g., part of. A first object may be coupled to a second object such that the first object is positioned at a specific, or pre-determined, location and orientation with respect to the second object. For example, a housing in which is disclosed an impeller may be coupled at the upper end to a conduit, e.g., the "second conduit" disclosed elsewhere herein. A first object may be either permanently or removably coupled to a second object. Two objects may be "permanently coupled" to each other via adhesive or welding; or they may be "removably coupled" via collets, screws, threading, or nuts and bolts such that they are capable of being easily separated and no longer coupled. Thus, a portion of a housing may be removably coupled to a seal such that the portion of the housing may then be uncoupled and removed from the seal. Two objects may be "rotatably coupled" together, e.g., where a first object may be rotated relative to a second object. For example, a shaft may be rotatably coupled to a body in a turbine where the shaft may be rotated relative to the body. Two objects may be "sealingly coupled,", e.g., where a first object may be abutted to a second object such that respective adjacent surfaces of the objects would be inhibited fluid from flowing therebetween. For example, a seal may be sealingly coupled to a fluid conduit where, in some cases, fluid cannot flow between adjacent surfaces of the seal and fluid conduit.

The term "cylindrical" as used herein is defined as shaped like a cylinder, e.g., having straight parallel sides and a circular or oval or elliptical cross-section. A cylindrical body or structure, e.g., housing, shaft assembly, or bearing assembly, may be completely or partially shaped like a cylinder. A cylindrical body, e.g., shaft assembly or housing, which has an outer diameter that changes abruptly may have a radial face or "lip" extending toward the center axis. A cylindrical body may have an aperture that extends through the entire length of the body to form a hollow cylinder that is capable of permitting fluid to pass through, e.g., water or hydrocarbon. On the other hand, a cylindrical structure may be solid, e.g., rod or peg. A drive shaft assembly is an example of a solid cylindrical body.

The term "disposed" as used herein means having been put, placed, positioned, inserted, or oriented in a particular location. For example, when a second conduit occupies a position within a first conduit, the second conduit is disposed in or within the first conduit. Also, a conduit or some other type of structure or aperture may be disposed on or disposed adjacent another structure or space.

The term "downhole wellbore system" means an assembly of components that include one or more conduits that are disposed in a wellbore and at least one electrical generator.

The term "elongated" as used herein describes something that has a length and width wherein the length is greater than the width and is preferably 5 or more times as long as it is wide. For example, the first and second conduits, and the first and second annular spaces disclosed herein are "elongated" given their lengths are substantially greater than their widths, e.g., outer diameters.

The term "entry port" means an aperture in a structure, e.g., a housing or a wall of a structure, through which fluid, e.g., reservoir fluid, is capable of passing, from outside the structure to the interior of the structure.

The term "exit port" means an aperture in a structure, e.g., a housing or a wall of a structure, through which fluid, e.g., reservoir fluid, passes from the interior of the structure, e.g., the housing or conduit, to outside the structure.

The terms "first," "second," "third," and other ordinal terms, when used to refer to certain things, e.g., structures, are terms that differentiate those things from one another and do not mean or imply anything in terms of importance, sequence, etc.

The term "flow" as used herein, as a verb, noun, or word that modifies another word, e.g., volume, describes or refers to the moving, or the movement or passage of a fluid, preferably substantially in a particular direction. For example, reservoir fluid may flow in a downward direction in the interior of a conduit or an annular space. Such flow can be laminar or turbulent, or a combination of laminar and turbulent. Flow volume in that context may be measured in a variety of units, e.g., gallons or liters. Time may be measured in seconds, minutes, or hours.

The term "fluid" as used herein is defined as a material that is capable of flowing. A fluid may be a liquid or a gas or some mixture of liquid and gas. A fluid may absorb heat. A fluid has inherent properties which may in certain embodiments are measurable, such as viscosity, anti-foaming, thermal stability, thermal conductivity, and thermal capacity.

The term "generator" as used herein is defined as an assembly that generates electricity, e.g., an assembly that converts motive power into electrical power, e.g., electricity.

The term "horizontal wellbore" as used herein is defined as a wellbore that has been drilled using some type of directional drilling technique and includes at least a portion that is more than 45 degrees from vertical. However, at least a portion of any horizontal wellbore is vertical or at least substantially vertical, as the term "vertical" is used in the oil and gas industry, i.e., pointed toward the center of the earth. For example, the upper portion of the wellbore closest to the surface is typically vertical, or substantially vertical, and the lower portion is less vertical and closer to perfectly horizontal relative to the earth's surface above that portion of the wellbore. For example, a horizontal wellbore may include a wellbore that is formed as a kick-out wellbore from an originally drilled vertical wellbore. Any horizontal wellbore mentioned herein is defined to include a "heel," which is the part, point, or section of the wellbore where the portion of the wellbore changes from being vertical to being horizontal, and the "toe" which refers to the end of the wellbore. In any discussion of wellbores herein, there is no restriction in length unless stated specifically otherwise, a central part of any elongated space, such as a conduit.

The term "housing" as used herein is defined as a structure, preferably a cylindrical sleeve, configured to be filled with fluid, e.g., water or hydrocarbon. A housing may have a central aperture which may be the space between the walls of the housing and extending from one end, e.g., the upper end, to the other end, e.g., the lower end. A housing may have one or more threaded ends for coupling with another housing. Multiple housings may be coupled axially to form a larger housing. A housing of a turbine may be coupled to a housing of a generator. A housing and a body disposed in the housing may share a central aperture.

The term "impeller" as used herein is defined as a structure that is part of a turbine, and that is capable of rotating relative to some other structure, surface, body and/or a housing. An impeller, when rotating, may cause flow of fluid, e.g., water, lubricant, or hydrocarbon. An impeller may be coupled to a rotatable shaft. One or more impellers may be disposed in a turbine.

The term "inner reservoir" means a volume or space that may be part of a turbine.

The term "magnet" as used herein is defined as an object that produces a magnetic field. A magnet may be constructed from a material that has been magnetized and creates its own persistent magnetic field, e.g., a permanent magnet. A magnet may include a strong rare-earth permanent magnet, e.g., Samarium Cobalt (Sm Co) or Neodymium iron Boron (Nd Fe B). A magnet may be a wall or may alternatively be a cylindrical, polygonal, and/or irregular structure, or a tubular structure, rod, polygonal cube, or walls having irregular contours. A magnet may be an arcuate wall.

The term "magnetic portion" as used herein is defined as any portion of the rotor that includes a magnet.

The term "perforation" means an aperture created as a result of perforating.

The term "port" as used herein is defined as an aperture in a structure for providing the ingress or egress of fluid. A port disposed in a casing, conduit; or turbine may be referred to as a "fluid port."

The term "pressure" as used herein means force(s), including but not limited to the forces exerted in every direction in an enclosed space, e.g., forces applied against the inside surfaces of any structure defining the enclosed space. Pressure may be, for example, exerted against a surface of an object, e.g., rotor, piston head, seat, and/or dart, from the fluid flow across the surface. "Hydrostatic pressure" is the pressure exerted by a fluid at rest due to the force of gravity. For example, a first portion water in a reservoir may exert hydrostatic pressure upon a second portion water in the reservoir to cause the second portion of water to flow through an available opening, e.g., into a turbine. Non-limiting examples of pressure include: (a) the formation pressure in a reservoir, including the formation pressure of the upper part of the reservoir adjacent to one or more of the upper perforations in the upper part of the first conduit, e.g., the upper part of the casing; (b) pressure in one of the annular spaces inside the wellbore, e.g., the pressure in the first annular space, between the inner surface of the upper part of the first conduit, e.g., the casing, and the outer surface of the upper part of the second conduit, and above the seal (e.g., packer); (c) pressure inside the second conduit; (d) pressure inside the second annular space, between the inner surface of the lower part of the first conduit, e.g., the lower part of the casing, and the outer surface of the lower part of the second conduit, and below the seal (e.g., packer); and (e) the formation pressure of the lower part of the reservoir adjacent to one or more of the lower perforations in the first conduit, e.g., the lower part of the casing. Although pressure is normally measured in kilopascals, kilopascals can be converted to joules, as a unit of energy, to combine with potential energy. Thus, pressure (measured in joules) and potential energy (measured in joules) in a reservoir may be combined.

The term "providing" as used herein is defined as making available, furnishing, supplying, equipping, or causing to be placed in position.

The term "reservoir" as used herein is defined as a volumetric space that contains fluid, e.g., lubricant, or is capable of containing fluid. A reservoir may be used to store fluid. A reservoir may be artificial or man-made, i.e., manufactured by humans, or it may be natural, i.e., existing in nature, such as an underground reservoir containing water or hydrocarbons. An example of a natural reservoir may be a body of rock and/or sediment that holds groundwater (also known as an aquifer). An artificial fluid reservoir may be defined by a housing, e.g., having walls. A reservoir may become depleted of material, e.g., hydrocarbon, that was once present in the reservoir such that pressure in the depleted reservoir is less than when material was present. Accordingly, pressure in an aquifer may be greater than pressure in a depleted reservoir below the aquifer. Groundwater may flow from the higher-pressure aquifer to the lower-pressure, depleted reservoir if a flow path were provided from one reservoir to the other. A reservoir may be defined by the inner surface of a housing and one or more surfaces of a body, e.g., group of coupled assemblies, disposed within the housing. A reservoir may have an upper end and a lower end with walls extending from or between the upper end and the lower end. Fluid may flow within a reservoir. For instance, an impeller may be disposed within a reservoir such that turning the impeller generates differential pressure to cause fluid to flow from one end of the fluid reservoir to the other. A reservoir may be in fluid communication with a flow path. Preferably, an upper end of the reservoir may be in fluid communication with an upper end of a flow path and a lower end of the fluid reservoir may be in fluid communication with a lower end of the flow path, thereby forming a fluid circulation loop.

The term "reservoir fluid" means any fluid, including liquid, gas, or a mixture of liquid and gas, which exists in or originated from a subterranean reservoir or that is or was at some point present in the subterranean reservoir, including underground water which may be fresh, potable, or salt water.

The term "rotor" as used herein is defined as a cylindrical structure capable of rotating, e.g., rotating relative to a stator in response to energization of the stator. A rotor may be disposed within a stator. A rotor may include a rotor body, one or more shaft assemblies, a magnetic portion having one or more magnets, and/or a sleeve. A rotor may be integral with, e.g., part of, a shaft assembly. A rotor may be a shaft assembly. A rotor may be coupled to one or more shaft assemblies. A rotor may have a magnetic portion. A rotor may have a magnetic portion having magnets disposed thereon. A rotor may have a magnetic portion disposed within a stator.

The term "seal" as used herein as a noun is defined as a structure that is capable of providing sealing contact when pressed against or otherwise in contact with some surface. A portion of the seal may be coupled to or abutted against a surface of a structure such that, in some cases, fluid is inhibited or even prevented from passing between the seal and the surface of the structure. A seal may be or include, for example, an O-ring or a packer. At least one non-limiting preferred example of a seal is a packer which, as illustrated in some of the drawings herein, is cylindrical and is disposed in the annular space between a first conduit and a second conduit, such that there is preferably a first annular space and a second annular space with the packer separating the two annular spaces. In that specific embodiment, the outer surface of the packer is pressed against the inner surface of the first conduit, and the inner surface of the packer is pressed against the outer surface of the second conduit. Preferably, the packer provides sealing contact with the surfaces of the conduits, and thus inhibits and preferably prevents fluid from passing past the areas of sealing contact, even when there is a substantial pressure difference between the first and second annular spaces.

The term "packer" is to be given its usual and customary meaning within the oil and gas industry, encompassing any type of structure that has been used in the past in oil wells and referred to as a "packer."

The term "shaft assembly" as used herein is defined as an assembly capable of rotating about an axis, e.g., an elongated shaft having an axis. One type of shaft assembly may be or include a rotor. A shaft may be rotatably coupled to a turbine body or generator stator. A shaft assembly may be formed from two coupled shaft assemblies. Torque and axial load may be transferred from a first shaft assembly to a second shaft assembly, e.g., rotor. A shaft assembly may include one or more impellers coupled to a shaft.

The term "space" as used herein means any volumetric space. For example, it may refer to some empty volume between two objects, structures, points, lines, edges, or surfaces, i.e., not occupied by any anything solid. A non-limiting example of space is "annular space," e.g., the space between the inside surface of one conduit and the outside surface of another conduit disposed inside the one conduit.

The term "stator" as used herein is defined as a structure that is part of a part of a generator, e.g., a permanent magnet motor (PMM) or induction motor, configured to generate or receive electricity. Preferably, a stator is a portion of an electric motor that remains fixed with respect to rotating parts, e.g., shaft, rotor, and/or impeller.

The term "surface" as used herein is defined as any boundary of a structure. A surface may also refer to that cylindrical area that extends radially around a cylinder which may, for example, be part of a shaft assembly or bearing assembly. A surface may also refer to that cylindrical area that extends radially around a cylinder which may, for example, be part of a housing, a stator, a rotor, or a shaft assembly. A "surface" may have any geometry, e.g., curved or flat. A surface may have irregular contours. A surface may be formed from components, e.g., bearing assemblies, bodies, and/or housings, coupled together. Coupled components may form irregular surfaces.

The term "turbine" as used herein is defined as an assembly that includes a rotor and an impeller for driving movement of an object, e.g., a shaft assembly and/or a rotor. Movement of an object may include rotation of the object on a central axis. Additionally, movement may include radial displacement or axial displacement of an object relative to another object. A turbine may be a progressive cavity positive displacement pump motor having one or more rotatable portions, e.g., drive shaft and/or rotors, having fins or blades extending from each rotatable portion. Fluid may flow across vanes, e.g., fins or blades, of a turbine. A turbine may include a housing and one or more rotatable portions, e.g., drive shaft and/or rotors, having fins or blades extending from each rotatable portion, disposed in the housing. A turbine may include a turbine housing having one or more ports disposed therethrough. The one or more ports may extend longitudinally, e.g., parallel to the central axis of the turbine, and disposed radially around the housing. The one or more ports may have circular profiles. Alternatively, one or more ports may be elongated. The one or more ports port may extend at an angle relative to the central axis of a turbine housing. A turbine may include a drive shaft assembly capable of being coupled to a rotor of a generator.

The term "unitary" as used herein means having the nature, properties, or characteristics of a single unit. For example, a shaft and a rotor may be unitary where they are connected, directly or indirectly, and fulfill the intended purpose of being rotated. Also, a shaft and an impeller may be unitary where they are connected, directly or indirectly, and fulfill the intended purpose of being rotated to move fluid, e.g., water, hydrocarbon, or lubricant.

The terms "upper" and "lower" as used herein are relative terms describing the position of one object, thing, or point positioned in its intended useful position, relative to some other object, thing, or point also positioned in its intended useful position, when the objects, things, or points are compared to distance from the center of the earth. For example, the term "upper" identifies any object or part of a particular object that is farther away from the center of the earth than some other object or part of that particular object, when the objects are positioned in their intended useful positions.

The term "well" as used herein is defined as the wellbore in combination with any related surface equipment outside the wellbore, such as pumps and piping, and also the area surrounding the wellbore such as the formation, including the hydraulic fractures.

The term "wellbore" as used herein is defined as the drilled elongated cylindrical borehole extending through the formation from the surface, where the drilling was initiated, to the endpoint where the drilling was terminated. Depending on the context, the term may also include any downhole components placed within the borehole, e.g., casing, cement, tubing, packers, etc.

3. Certain Specific Embodiments

The disclosure herein includes systems for generating electricity using reservoir fluid, and methods for generating electricity using those systems, which systems may include: a first conduit in a wellbore, the first conduit having an interior and including: an upper perforation capable of providing for the passage of reservoir fluid therethrough; and a lower perforation capable of providing for the passage of reservoir fluid therethrough; a second conduit in the wellbore, the second conduit having an interior and including an upper port capable of providing for the passage of reservoir fluid from the interior of the first conduit to the interior of the second conduit; an annular barrier disposed in the interior of the first conduit below the upper perforation and below the upper port of the second conduit and above the lower perforation, the annular barrier being capable of inhibiting reservoir fluid from flowing past the annular barrier; a housing coupled to the second conduit, the housing having an interior and including a lower port capable of providing for the passage of reservoir fluid from or to the interior of the housing; an impeller disposed in the housing, wherein the impeller may be capable of being rotated by moving fluid flowing within the interior of the second housing; and a generator disposed outside the housing, the generator including a rotor coupled to the impeller.

Additionally, the disclosure herein includes systems for generating electricity using reservoir fluid, and methods for generating electricity using those systems, which systems may include: a first conduit in a wellbore, the first conduit having an interior and including: an upper perforation capable of providing for the passage of reservoir fluid therethrough; and a lower perforation capable of providing for the passage of reservoir fluid therethrough; a second conduit in the wellbore, the second conduit having an interior and including an upper port capable of providing for the passage of reservoir fluid from the interior of the first conduit to the interior of the second conduit; an annular barrier disposed in the interior of the first conduit below the upper perforation and below the upper port of the second conduit and above the lower perforation, the annular barrier being capable of inhibiting reservoir fluid from flowing past the annular barrier; a first housing coupled to the second conduit, the first housing having an interior and including a lower port capable of providing for the passage of reservoir fluid from or to the interior of the first housing; a second housing disposed in the first housing; an impeller disposed in the second housing, wherein the impeller may be capable of being rotated by moving fluid flowing within the interior of the second housing; and a generator disposed outside the second housing and inside the first housing, the generator including a rotor coupled to the impeller.

Also, the disclosure herein includes systems for generating electricity using reservoir fluid, and methods for generating electricity using those systems, which systems may include: a first conduit in a wellbore that has an interior and includes: one or more upper perforations capable of providing for the passage of reservoir fluid therethrough; and one or more lower perforations capable of providing for the passage of reservoir fluid therethrough; an annular barrier disposed in the interior of the first conduit below the upper perforation and above the lower perforation and capable of inhibiting reservoir fluid from flowing past the annular barrier; a second conduit disposed inside the first conduit, the second conduit having an interior and one or more upper ports; an annular space between the first conduit and the second conduit, wherein: at least one of the one or more upper ports may be configured to provide for passage of reservoir fluid from the annular space into the interior of the second conduit and wherein the annular space may include a first annular space above the barrier and a second annular space below the barrier, and wherein the barrier may be capable of inhibiting the flow of fluid downward past the barrier from the first annular space to the second annular space; a housing coupled to the second conduit, the housing having a lower port; an impeller disposed in the housing; a generator disposed outside the housing, the generator including a rotor coupled to the impeller; and a cable capable of transmitting electricity upward through the wellbore to the surface.

In addition, the disclosure herein includes systems for generating electricity using reservoir fluid, and methods for generating electricity using those systems, which systems may include: a first conduit in a wellbore that has an interior and includes: one or more upper perforations capable of providing for the passage of reservoir fluid therethrough; and one or more lower perforations capable of providing for the passage of reservoir fluid therethrough; a barrier disposed in the interior of the first conduit below the upper perforation and above the lower perforation and capable of inhibiting reservoir fluid from flowing past the barrier; a second conduit disposed inside the first conduit, the second conduit having an interior and one or more upper ports; a cylindrical housing coupled to the second conduit, wherein the housing may have a cylindrical wall, an interior portion, an upper end opening, and a lower end opening; a third conduit extending from the lower end opening of the cylindrical housing into the barrier; a barrier below the at least one of the one or more upper ports, wherein the annular barrier may be disposed around the third conduit, and may be capable of inhibiting the flow of fluid past the barrier; an impeller disposed in the housing; a generator disposed in the interior of the cylindrical housing, the generator including a rotor coupled to the impeller; and a cable capable of transmitting electricity upward through the wellbore to the surface.

Furthermore, the disclosure herein includes methods of generating electricity using any of the systems disclosed herein, which methods may include: providing a downhole wellbore system into a wellbore, which downhole wellbore system may include: a first conduit in a wellbore that has an interior and may include: one or more upper perforations capable of providing for the passage of reservoir fluid therethrough; and one or more lower perforations capable of providing for the passage of reservoir fluid therethrough; an annular barrier disposed in the interior of the first conduit below the upper perforation and above the lower perforation and capable of inhibiting reservoir fluid from flowing past the annular barrier; a second conduit disposed inside the first conduit, the second conduit having an interior and one or more upper ports; an annular space between the first conduit and the second conduit; a housing coupled to the second conduit, the housing having a lower port; an impeller disposed in the housing; a generator disposed outside the housing, the generator may include a stator, a rotor coupled to the impeller, and a magnet coupled to the rotor; and a cable coupled to the generator; causing reservoir fluid to flow through the upper port through the conduit into the turbine; rotating the impeller with reservoir fluid flowing through the turbine, and out through the lower port, wherein the magnet may also be rotated relative to the stator; and generating electricity when the magnet is rotated.

Moreover, the disclosure herein includes methods of generating electricity using reservoir fluid, which methods may include: providing a downhole wellbore system into the wellbore, which downhole wellbore system may include: a first conduit in a wellbore that has an interior and may include: one or more upper perforations capable of providing for the passage of reservoir fluid therethrough; and one or more lower perforations capable of providing for the passage of reservoir fluid therethrough; a barrier disposed in the interior of the first conduit below the upper perforation and above the lower perforation and capable of inhibiting reservoir fluid from flowing past the barrier; a second conduit disposed inside the first conduit, the second conduit having an interior and one or more upper ports; a cylindrical housing coupled to the second conduit, wherein the housing may have a cylindrical wall, an interior portion, an upper end opening, and a lower end opening; a third conduit extending from the lower end opening of the cylindrical housing into the barrier; a barrier below the at least one of the one or more upper ports, wherein the annular barrier may be disposed around the third conduit; an impeller disposed in the housing; a generator disposed in the interior of the cylindrical housing, the generator may include stator, a magnet, and a rotor coupled to the impeller; and is capable of inhibiting the flow of fluid past the barrier; causing reservoir fluid to flow through the upper port through the second conduit and into the housing; causing reservoir fluid to flow through the housing; rotating the impeller with reservoir fluid flowing through the housing and out of the exit port, wherein the magnet may also be rotated relative to the stator; and generating electricity when the magnet is rotated.

In any one of the structures disclosed herein, the housing may be disposed in the wellbore below the annular barrier.

In any one of the structures disclosed herein, the housing may further have an inner reservoir configured to receive downwardly moving fluid from the interior of the second conduit.

In any one of the structures disclosed herein, the annular barrier may be sealingly coupled to the first conduit.

In any one of the structures disclosed herein, the annular barrier may be sealingly coupled to the second conduit.

In any one of the structures disclosed herein, the annular barrier may be sealingly coupled to the housing.

In any one of the structures disclosed herein, the impeller may be capable of being rotated by downwardly moving fluid flowing from the interior of the second conduit.

In any one of the structures disclosed herein, the upper port may be configured to provide passage of fluid into of the second conduit.

In any one of the structures disclosed herein, the lower port may be configured to provide passage of fluid out of the housing.

In any one of the structures disclosed herein, the generator may be disposed below the housing.

In any one of the structures disclosed herein, the generator may further include: a stator disposed around a portion of the rotor; and a magnet coupled to the rotor and disposed within the stator, wherein rotating the impeller may also rotate the magnet relative to the stator, causing generation of electricity.

In any one of the structures disclosed herein, the upper perforation may be capable of providing for the passage of reservoir fluid from a reservoir outside the wellbore and adjacent the upper perforation to the interior of the first conduit; and the lower perforation may be capable of providing for the passage of reservoir fluid from the interior of the first conduit to a reservoir outside the wellbore and adjacent the lower perforation.

In any one of the structures disclosed herein, the lower perforation may be capable of providing for the passage of reservoir fluid from a reservoir outside the wellbore and adjacent the lower perforation to the interior of the first conduit; and the upper perforation may be capable of providing for the passage of reservoir fluid from the interior of the first conduit to a reservoir outside the wellbore and adjacent the upper perforation.

In any one of the structures disclosed herein, the annular barrier may include a packer.

In any one of the structures disclosed herein, the second conduit may have a smaller outer diameter than inner diameter of the first conduit and is disposed inside the first conduit.

Any one or more of the systems disclosed herein may further include an electrical converter electrically coupled to the generator.

Any one or more of the systems disclosed herein may further include a power source capable of storing electricity generated by the generator.

In any one of the structures disclosed herein, the seal may include a packer.

In any one of the structures disclosed herein, the second conduit may have a smaller outer diameter than inner diameter of the first conduit and may be disposed inside the first conduit.

Any one or more of the systems disclosed herein may further include an electrical converter electrically coupled to the generator.

Any one or more of the systems disclosed herein may further include a power source capable of storing electricity generated by the generator.

In any one of the structures disclosed herein, the first annular space may have an axial distance greater than the axial distance of the second annular space.

Any one or more of the systems disclosed herein may further include a valve coupled to the perforation capable of being opened to permit the passage of reservoir fluid through the perforation and may also be capable of being closed to prevent the passage of reservoir fluid through the perforation.

Any one or more of the systems disclosed herein may further include a valve coupled to the upper port capable of being opened to permit the passage of reservoir fluid through the upper port.

In any one of the structures disclosed herein, the first conduit may include well casing and the one or more perforations may include perforations created during a perforating operation performed during completion of the well.

In any one of the structures disclosed herein, the one or more perforations may include three or more perforations distributed at different locations around the circumference of the first conduit.

In any one of the structures disclosed herein, the second conduit may include a tubular and the one or more upper ports may include three or more upper ports distributed at different locations around the circumference of the tubular.

In any one of the structures disclosed herein, reservoir fluid flowing from the conduit into the turbine may be driven by hydrostatic pressure.

Any one or more of the systems disclosed herein may further include an electrical converter electrically coupled to the generator.

Any one or more of the systems disclosed herein may further include a power source capable of storing electricity generated by the generator.

In any one of the structures disclosed herein, the perforation may be disposed below the upper port.

In any one of the structures disclosed herein, the lower port may be disposed above the generator.

In any one of the structures disclosed herein, the generator may be disposed below the impeller.

In any one of the structures disclosed herein, the second conduit may extend into the upper end opening of the cylindrical housing end.

In any one of the structures disclosed herein, the cylindrical housing may be coupled to the second conduit.

In any one of the structures disclosed herein, the third conduit may extend through the barrier.

In any one of the structures disclosed herein, the third conduit may have an outer diameter smaller than an outer diameter of the housing.

In any one of the structures disclosed herein, the third conduit may have an outer diameter smaller than an inner diameter of the barrier.

In any one of the structures disclosed herein, the third conduit may be removably coupled to the barrier.

In any one of the structures disclosed herein, the third conduit may be capable of being removed from the barrier while the barrier is coupled to the first conduit.

In any one of the structures disclosed herein, the third conduit may be capable of being pushed through the barrier while the barrier is coupled to the first conduit.

In any one of the structures disclosed herein, the upper housing end may be coupled to the conduit.

In any one of the structures disclosed herein, the lower housing end may be open.

In any one of the structures disclosed herein, fluid may be capable of flowing through the lower housing end.

In any one of the structures disclosed herein, the lower housing end may be coupled to the seal.

In any one of the structures disclosed herein, the lower housing end may be capable of ingress through or egress from the seal.

In any one of the structures disclosed herein, the lower upper port may be disposed below the perforation.

4. Specific Embodiments in the Drawings

The drawings presented herein are for illustrative purposes only and do not limit the scope of the disclosure or claims. Rather, the drawings are intended to help enable one having ordinary skill in the art to make and use the systems and assemblies and practice the methods disclosed herein.

This section addresses specific versions of downhole wellbore systems shown in the drawings, which include assemblies, elements and parts that can be part of one or more downhole wellbore systems or downhole methods for generating electricity. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability than the structures disclosed in the drawings.

FIG. 1A shows an example of a downhole wellbore system 100 for generating electricity using reservoir fluid. This particular wellbore system 100 includes a casing 106 (an example of a first conduit) located in a wellbore 102. One or more upper perforations 108*a* in the casing 106 are capable of providing fluid communication between the reservoir 104*a* adjacent the upper perforations 108*a*, e.g., the water reservoir, and an annular space inside the casing that is adjacent the upper perforations 108*a*. That system 100 also has: a second conduit 110, preferably disposed within the casing 106, e.g., a tubular, having an interior and through which fluid can flow, preferably downward, and also having one or more upper ports 114 in the wall of the second conduit positioned below at least some, and preferably all, of the upper perforations. Although FIG. 1A shows only a single perforation 108*a* and a single upper port 114 it is understood that different embodiments may have multiple perforations 108*a* and multiple upper ports 114, which can be positioned in different locations on the respective first and second conduits 106, 110 as discussed elsewhere herein.

That system 100 also preferably has an annular space between the first conduit 106 and the second conduit 110, wherein: one or more of the upper perforations is configured to provide passage of reservoir fluid from a reservoir 104*a* into the annular space, and the upper ports 114 are configured to provide passage of reservoir fluid from the annular space into the interior of the second conduit 110.

The system 100 also includes an annular barrier 112, e.g., a seal such as a packer, disposed in the annular space between the inner wall of the first conduit 106 and the outer wall of the second conduit 110 below at least one upper port 114 and preferably all of the upper ports. The annular space comprises a first annular space 118*a* above the barrier 112 and a second annular space 118*b* below the barrier 112, and the barrier 112 is capable of preventing or at least inhibiting fluid from flowing downward past the barrier 112 from the first annular space 118*a* to the second annular space.

The system 100 also includes a turbine 200 disposed in the wellbore 102 below the barrier 112, the turbine 200 having: (a) a housing that has an inner reservoir configured to receive downwardly moving fluid from the interior of the second conduit 110, (b) an impeller 206 disposed inside the housing that is capable of being rotated by fluid flowing through the interior of the housing from the interior of the second conduit 110; and (c) a lower port 216 configured to provide for the passage of fluid from inside of the housing and the impeller 206 to the second annular space 118*b*; and a generator 300 disposed outside the housing and below the turbine 200. Preferably, the generator 300 includes a stator 304; a rotor 306 coupled to the impeller 206; and a magnet 312 coupled to the rotor 306 and disposed within the stator 304, wherein rotating the impeller 206 also rotates the magnet 312 relative to the stator 304, causing generation of electricity.

FIG. 1A includes a specific example of a downhole wellbore system 100 in which reservoir fluid enters the first conduit through an upper perforation and exits through a lower perforation, so that fluid is flowing in a downward direction. It is understood that in an alternative embodiment the components of the system can be arranged differently, so that the fluid is flowing in an upward direction. FIG. 1A depicts a wellbore 102 that is a vertical wellbore, but it is understood that the system 100 may also include or be used in a horizontal wellbore. The wellbore 102 extends downward and underground, preferably across multiple zones of rock formations. The terrestrial zones include an upper reservoir 104*a*, e.g., water reservoir, and a lower reservoir

104*b*, wherein the upper reservoir 104*a* depicted in FIG. 1A is closer than the lower reservoir 104*b* to the surface, so that the water reservoir may be referred to as a "water reservoir" and the lower reservoir as a "hydrocarbon reservoir" (which may have a higher proportion of hydrocarbons than the water reservoir but which may also include some water as well). Preferably, as discussed in greater detail below, the formation pressure of the water reservoir (P1) is higher than the formation pressure of the hydrocarbon reservoir (P5). Thus, in a preferred embodiment, some quantity of hydrocarbons have already been produced from, e.g., removed from, the hydrocarbon reservoir so that the formation is depleted to at least some extent, and preferably to the extent that the pressure P5 in the hydrocarbon reservoir that is subjected to the introduction of reservoir water via the annular space within the first conduit is lower than the original formation pressure, i.e., the formation pressure in the hydrocarbon reservoir before production was initiated. Thus, in a preferred embodiment, the methods disclosed herein for generating electricity are performed in a partially depleted reservoir, after removal of at least some of the hydrocarbons from the hydrocarbon reservoir. Preferably, the casing 106 that can be part of the downhole wellbore system 100 depicted in FIG. 1A is casing that was previously run into and installed in the wellbore when hydrocarbons were being produced from the well. To assemble one of the downhole wellbore systems described herein, e.g., as shown in FIG. 1A, the production tubing (not shown) which was part of the producing well, was removed, and was replaced with the second conduit 110 described below.

At least a portion of the wellbore 102 may be lined with and supported by a hardened casing 106 (an example of a first conduit). Such casing 106 is a type of conduit and may be constructed from steel and may be considered to also include cement that surrounds the steel walls of the casing. A first (upper) portion of the casing 106 has one or more perforations 108*a* (upper apertures) that extend through the walls of the casing. Fluid, e.g., fresh or salt water, from the upper reservoir 104*a* may pass through the one or more first set of upper perforations 108*a* and into the annular space, preferably the upper annular space 118*a*, discussed below. Preferably, the formation pressure P1 in the upper reservoir 104*a* is higher than pressure P2 in the upper annular space 118*a*, so that reservoir fluids in the water reservoir, e.g., water, flows from the upper reservoir 104*a* through the upper perforations 108*a* and into the upper annular space 118*a*, without the need for a pump.

Further downhole, a second (lower) portion of the casing 106 has a second set of one or more second apertures, e.g., perforations 108*b* disposed therethrough. Fluid that is inside the casing 106 passes through those perforations 108*b* to a point outside the casing 106, e.g., into the lower reservoir 104*b*. Thus, for example, fresh water, originating from the upper reservoir 104*a* may exit the wellbore 102 through the one or more second perforations 108*b* into adjacent rock formation that contains the lower reservoir 104*b*, after that fresh water passes through other parts of the system 100. Those perforations 108*b* may be distributed around the circumference of the casing 106, and they may also be distributed vertically along the walls of the casing 106 adjacent the upper reservoir 104*a*, in the same way the upper perforations 108*a* are distributed.

A seal 112, e.g., a packer, is disposed in the wellbore 102 in the annular space between the casing 106 and a second conduit 110. The seal 112 in the specific embodiment shown in FIG. 1A is cylindrical and includes a curved outermost surface extending circumferentially along the outer portion of the seal 112, farthest from the axis that extends through the center of the second conduit 110. That curved outer surface of the seal 112 is pressed against inner surface of the casing 106 with sufficient force to form a seal at the interface between the curved outer surface of the seal 112 and the curved inner surface of the casing 106. Outer surfaces of the seal 112 are abutted against inner surfaces of the casing 106. Thus, the seal 112 is sealingly coupled to the casing 106 because fluid cannot pass between the seal 112 and the casing 106. Moreover, the seal 112 is capable of separating fluid from the upper reservoir 104*a* (above the seal 112) and fluid from the lower reservoir 104*b* (below the seal 112).

The downhole wellbore system 100 includes a second conduit 110, a turbine 200 coupled to the conduit 110, and a generator 300 coupled to the turbine 200. The conduit 110 extends downhole into the casing 106 from a wellhead 116 set above ground. In other words, the second conduit 110 is suspended from the wellhead 116.

The second conduit 110 has a smaller outer diameter than any internal diameter of the casing 106 (to the extent the diameter of the casing 106 is different at different points along the wellbore 102). Thus, an upper annular space 118*a* exists between the second conduit 110 and the casing 106. Pressure P2 in the upper annular space 118*a* is less than pressure P1 in the upper reservoir 104*a*. Thus, fluid from the upper reservoir 104*a* may enter the upper annular space 118*a*.

Additionally, a portion of the second conduit 110 extends through the seal 112, i.e., the seal 112 has an annular cross-section when viewed from above, so that it wraps around the second conduit 110. Inner surfaces of the seal 112 are abutted against outer surfaces of the conduit 110. Therefore, the seal 112 is sealingly coupled to the conduit 110 because fluid cannot pass between the seal 112 and the conduit 110.

Above the seal 112, an upper port 114 is disposed through the second conduit 110. Pressure P3 in the second conduit 110 is less than pressure P2 in the upper annular space 118*a*. Thus, the second conduit 110 may receive fluid, e.g., freshwater, from the upper reservoir 104*a*. Arrows in FIG. 1A indicate a path of fluid flow from the upper reservoir 104*a* through the first perforations 108*a* of the casing 106, into the upper annular space 118*a*, through the upper port 114, and into the second conduit 110.

In some cases, well operators may inhibit entry of fluid from the upper reservoir 104*a* entry through the upper port 114 by pressing one or more sleeves (not shown) against inner surfaces of the second conduit 110 and the one or more first perforations 108*a*. The well operators may lower the one or more sleeves via special settings tools, e.g., on wireline or coiled tubing, (not shown). The settings tools may be actuated to press the one or more sleeves over the upper port 114.

Fluid in the second conduit 110 may flow into the turbine 200 through an upper portion of the turbine 200. The fluid may flow down, inside the turbine 200. Furthermore, pressure P4 in the lower annular space 118*b* is less than pressure in the turbine 200. Thus, the fluid may exit through one or more lower ports 216 of the turbine 200 into the wellbore 102 below the seal 112. The fluid may then exit the wellbore 102 through the one or more second perforations 108*b* of the casing 106 into adjacent rock formation containing the lower reservoir 104*b*.

Figure 1B:
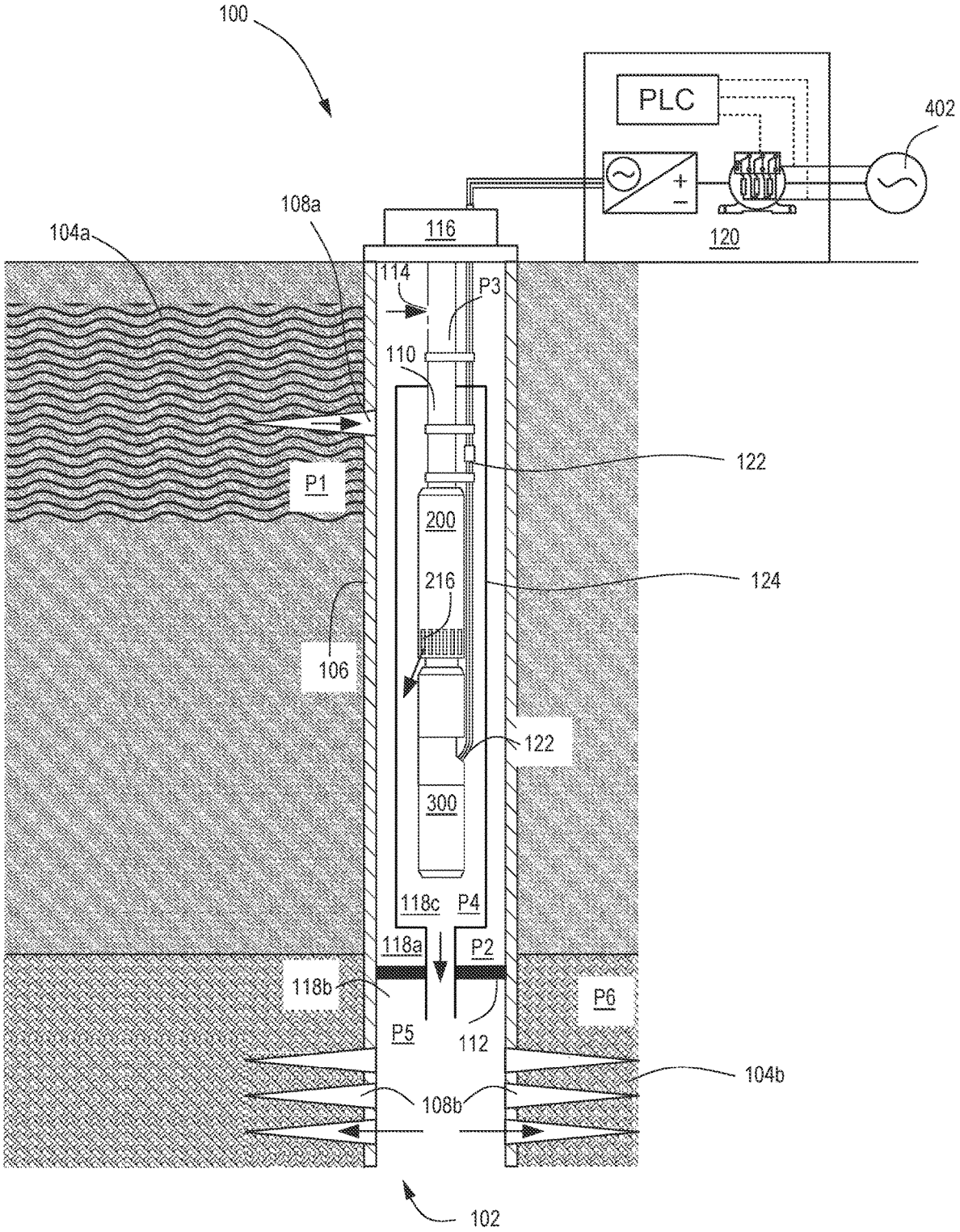
FIG. 1B is a schematic drawing that illustrates an example of a downhole wellbore system that includes a cross-sectional view of a housing disposed around a turbine and a generator

FIG. 1B is a schematic drawing that illustrates an example of a downhole wellbore system 100 that includes a separate outer housing 124 disposed around the inner housing of the turbine 200 and a generator 300. The wellbore system 100 includes a casing 106 (an example of a first conduit) located in a wellbore 102. One or more upper perforations 108*a* in the casing 106 are capable of providing fluid communication between the reservoir 104*a* adjacent the upper perforations 108*a*, e.g., the water reservoir, and an annular space inside the casing that is adjacent the upper perforations 108*a*. That system 100 also has: a second conduit 110, preferably disposed within the casing 106, e.g., a tubular, having an interior and through which fluid can flow, preferably downward, and also having one or more upper ports 114 in the wall of the second conduit positioned above at least some, and preferably all, of the upper perforations.

Although FIG. 1B shows upper ports 114 disposed above the perforation 108*a*, it should be understood that different embodiments may have upper ports 114 disposed below or at the same depth as the perforations 108*a*. Additionally, FIG. 1B shows only a single perforation 108*a* and a single upper port 114 it is understood that different embodiments may have multiple perforations 108*a* and multiple upper ports 114, which can be positioned in different locations on the respective first and second conduits 106, 110.

That system 100 also preferably has an annular space between the first conduit 106 and the second conduit 110, wherein: one or more of the upper perforations is configured to provide passage of reservoir fluid from a reservoir 104*a* into the annular space, and the upper ports 114 are configured to provide passage of reservoir fluid from the annular space into the interior of the second conduit 110.

Below the upper ports 114, an upper end of outer housing 124 is sealingly coupled, e.g., welded, to the second conduit 110, although in an alternative embodiment the upper end of the outer housing 124 may have a circular aperture or other type of opening that is threaded, e.g., with female threading, and is threadingly connected to a lower portion of the second conduit that have male threading. A lower end of the outer housing 124 is open to allow reservoir fluid to exit therethrough. The lower end of the housing 124 may be sealingly coupled, e.g., welded, to the upper end of the housing 124. In other words, the upper end and the lower end of the housing 124 may be two separate pieces. In some cases, they may be unitary. Nevertheless, the diameter of the lower end of the housing 124 is smaller than the upper end of the housing 124.

Inside the upper end of the outer housing 124 is a turbine 200 that includes an inner turbine housing 202 (see FIG. 2A) coupled to the lower end of the second conduit 110 and a generator 300 coupled to the outside of the inner turbine housing 202. Accordingly, a housing annular space 118*c* is disposed between inner wall of the outer housing 124 and a lower portion of the second conduit 110, the turbine 200, and the generator 300. The turbine 200 has: (a) housing that has an inner reservoir configured to receive downwardly moving fluid from the interior of the second conduit 110, (b) an impeller 206 disposed inside the inner turbine housing 202 that is capable of being rotated by fluid flowing through the interior of the second conduit 110; and (c) a lower port 216 configured to provide for the passage of fluid from inside the inner turbine housing 202 and the impeller 206 to the housing annular space 118*c*; and the generator 300 disposed below the turbine 200. The generator 300 is disposed outside the inner turbine housing 202 but is inside the outer housing 124. Preferably, the generator 300 includes a stator 304; a rotor 306 coupled to the impeller 206; and a magnet 312 coupled to the rotor 306 and disposed within the stator 304, wherein rotating the impeller 206 also rotates the magnet 312 relative to the stator 304, causing generation of electricity.

Additionally, the system 100 in FIG. 1B includes an annular barrier 112, e.g., a seal such as a packer, disposed in the annular space between the inner wall of the first conduit 106 and the outer wall of the outer housing 124 below at least one upper port 114 and preferably all of the upper ports. The barrier 112 is disposed around a portion of the lower end of the outer housing 124. Also, the lower end of the outer housing 124 extend through the barrier 112. The annular space comprises a first annular space 118*a* above the barrier 112 and a second annular space 118*b* below the barrier 112, and the barrier 112 is capable of preventing or at least inhibiting fluid from flowing downward past the barrier 112 from the first annular space 118*a* to the second annular space.

FIG. 1B includes a specific example of a downhole wellbore system 100. FIG. 1B depicts a wellbore 102 that is a vertical wellbore, but it is understood that the system 100 may also include or be used in a horizontal wellbore. The wellbore 102 extends downward and underground, preferably across multiple zones of rock formations. The terrestrial zones include an upper reservoir 104*a* and a lower reservoir 104*b*, wherein the upper reservoir 104*a* depicted in FIG. 1B is closer than the lower reservoir 104*b* to the surface, so that the upper reservoir 104*a* may be referred to as a "water reservoir" and the lower reservoir 104*b* as a "hydrocarbon reservoir." Preferably, as discussed in greater detail below, the formation pressure of the upper reservoir (P1) is higher than the formation pressure of the hydrocarbon reservoir (P6). Thus, in a preferred embodiment, some quantity of hydrocarbons have already been produced from, e.g., removed from, the hydrocarbon reservoir so that the formation is depleted to at least some extent, and preferably to the extent that the pressure P6 in the hydrocarbon reservoir that is subjected to the introduction of reservoir water via the annular space within the first conduit is lower than the original formation pressure, i.e., the formation pressure in the hydrocarbon reservoir before production was initiated. Thus, in a preferred embodiment, the methods disclosed herein for generating electricity are performed in a partially depleted reservoir, after removal of at least some of the hydrocarbons from the hydrocarbon reservoir. Preferably, the casing 106 that can be part of the downhole wellbore system 100 depicted in FIG. 1B is casing that was previously run into and installed in the wellbore when hydrocarbons were being produced from the well. To assemble one of the downhole wellbore systems described herein, e.g., as shown in FIG. 1B, the production tubing (not shown) which was part of the producing well, was removed, and was replaced with the second conduit 110 described below.

At least a portion of the wellbore 102 may be lined with and supported by a hardened casing 106 (a first conduit). Such casing 106 is a type of conduit and may be constructed from steel and may be considered to also include cement that surrounds the steel walls of the casing. A first (upper) portion of the casing 106 has one or more perforations 108*a* (upper apertures) that extend through the walls of the casing. Fluid, e.g., fresh or salt water, from the upper reservoir 104*a* may pass through the one or more first set of upper perforations 108*a* and into the annular space, preferably the upper annular space 118*a*, discussed below. Preferably, the formation pressure P1 in the upper reservoir 104*a* is higher than pressure P2 in the upper annular space 118*a*, so that reservoir fluids in the water reservoir, e.g., water, flows from the upper reservoir 104*a* through the upper perforations 108*a* and into the upper annular space 118*a*, without the need for a pump.

Further downhole, a second (lower) portion of the casing 106 has a second set of one or more second apertures, e.g., perforations 108*b* disposed therethrough. Fluid that is inside the casing 106 passes through those perforations 108*b* to a point outside the casing 106, e.g., into the lower reservoir 104*b*. Thus, for example, fresh water, originating from the upper reservoir 104*a* may exit the wellbore 102 through the one or more second perforations 108*b* into adjacent rock formation that contains the lower reservoir 104*b*, after that fresh water passes through other parts of the system 100. Those perforations 108*b* may be distributed around the circumference of the casing 106, and they may also be distributed vertically along the walls of the casing 106 adjacent the upper reservoir 104*a*, in the same way the upper perforations 108*a* are distributed.

A seal 112, e.g., a packer, is disposed in the wellbore 102 in the annular space between the casing 106 and an outer housing 124. The seal 112 in the specific embodiment shown in FIG. 1B is cylindrical and includes a curved outermost surface extending circumferentially along the outer portion of the seal 112, farthest from the axis that extends through the center of the second conduit 110. That curved outer surface of the seal 112 is pressed against inner surface of the casing 106 with sufficient force to form a seal at the interface between the curved outer surface of the seal 112 and the curved inner surface of the casing 106. Outer surfaces of the seal 112 are abutted against inner surfaces of the casing 106. Thus, the seal 112 is sealingly coupled to the casing 106 because fluid cannot pass between the seal 112 and the casing 106. Moreover, the seal 112 is capable of separating fluid from the upper reservoir 104*a* (above the seal 112) and fluid from the lower reservoir 104*b* (below the seal 112).

The downhole wellbore system 100 includes a second conduit 110, a turbine 200 coupled to the conduit 110, and a generator 300 coupled to the turbine 200. A portion of the second conduit 110, the turbine 200, and a generator 300 are disposed inside an outer housing 124. The conduit 110 extends downhole into the casing 106 from a wellhead 116 set above ground into the outer housing 124. In other words, the second conduit 110 is suspended from the wellhead 116.

The second conduit 110 has a smaller outer diameter than any internal diameter of the casing 106 (to the extent the diameter of the casing 106 is different at different points along the wellbore 102). Thus, an upper annular space 118*a* exists between the second conduit 110 and the casing 106. Pressure and potential energy P2 in the upper annular space 118*a* is less than pressure and potential energy P1 in the upper reservoir 104*a*. Thus, fluid from the upper reservoir 104*a* may enter the upper annular space 118*a*.

Additionally, an open lower end of the outer housing 124 extends through the seal 112, i.e., the seal 112 has an annular cross-section when viewed from above, so that it wraps around the lower end of the outer housing 124. The lower end of the housing 124 has a radius smaller than a radius of an upper end of the outer housing 124. Inner surfaces of the seal 112 are abutted against outer surfaces of the lower end of the outer housing 124. Therefore, the seal 112 is sealingly coupled to the lower end of the outer housing 124 because fluid cannot pass between the seal 112 and the outer housing 124.

Above the seal 112, an upper port 114 is disposed through the second conduit 110. Pressure and potential energy P3 in the second conduit 110 is less than pressure and potential energy P2 in the upper annular space 118*a*. Thus, the second conduit 110 may receive fluid, e.g., freshwater, from the upper reservoir 104*a*. Arrows in FIG. 1B indicate a path of fluid flow from the upper reservoir 104*a* through the first perforations 108*a* of the casing 106, into the upper annular space 118*a*, through the upper port 114, and into the second conduit 110.

In some cases, well operators may inhibit entry of fluid from the upper reservoir 104*a* entry through the upper port 114 by pressing one or more sleeves (not shown) against inner surfaces of the second conduit 110 and/or the one or more first perforations 108*a*. The well operators may lower the one or more sleeves via special settings tools, e.g., on wireline or coiled tubing, (not shown). The settings tools may be actuated to press the one or more sleeves over the upper port 114 and/or the one or more first perforations 108*a*.

Fluid in the second conduit 110 may flow into the turbine 200 through an upper portion of the turbine 200. The fluid may flow down, inside the turbine 200. Pressure and potential energy P4 in the outer housing 124 is less than pressure and potential energy P3 in the turbine 200. Thus, the fluid may exit through one or more lower ports 216 of the turbine 200 into an outer housing annular space 118*c* above the seal 112. The fluid may then exit the open lower end of the outer housing 124 into the second annular space 118*b* because pressure and potential energy P5 in the second annular space 118*b* is less than pressure and potential energy P4 in the outer housing 124. The fluid may then exit the wellbore 102 through the one or more second perforations 108*b* of the casing 106 into adjacent rock formation containing the lower reservoir 104*b* because the rock formation has pressure and potential energy P6 less than pressure and potential energy P5 in the second annular space 118*b*.

A generator 300 is coupled to a lower end of the turbine 200. The generator may include a rotor 306 (see FIG. 2A and FIG. 3) that is coupled to a shaft 204 disposed in the turbine 200 (see FIG. 2A).

Electricity generation occurs when fluid from the upper reservoir 104*a* flows, e.g., via hydrostatic pressure and potential energy, through the turbine 200, thereby causing the shaft 204 in the turbine 200 and the rotor 306 in the generator 300 to rotate, which actuates the generator 300 to generate electricity. Generated electricity is transferred from the generator 300 to a surface power converting assembly 120 via one or more electric cables 122. The one or more electric cable 122 are electrically coupled to the generator 300 and the surface power converting assembly 120. In addition, the one or more electric cable 122 extends from the generator 300 up the wellbore 102 through the outer housing 124 towards the surface power converting assembly 120.

The outer housing 124 includes apertures (not shown) through which the one or more electric cable 122 extend. Seals (not shown) are disposed in the apertures between the outer housing 124 and the one or more electric cable 122 to inhibit fluid entry or exit between the outer housing 124 and the one or more electric cable 122, In some cases, for purposes of remediation and/or repair, an operator may remove the outer housing 124 from the seal 112. First, operator may obstruct fluid flow through the one or more first perforations 108*a*, e.g., via a temporary seal, plug, or patch. Next, the operator may pull up on the second conduit 110 which raises the outer housing 124, the turbine 200, and the generator 300. Accordingly, by raising the outer housing 124, the lower end of the outer housing 124 would be slid out of an aperture of the seal 112. The seal 112 would remain coupled to the casing 106. After completing remediation and/or repair, the operator may lower the second conduit 110, thereby lowering the lower end of the outer housing 124 through the aperture of the seal 112. Afterwards, the operator may sealingly couple the seal 112 to the outer housing 124.

Although the description above of FIG. 1A and FIG. 1B discusses the flow of fluid in a downwardly direction from an upper reservoir 104*a* (containing water) through systems 100 into a lower reservoir 104*b* (containing hydrocarbon), it should be understood that systems 100 can be arranged so that fluid can flow in an upwardly direction from a lower reservoir 104*b* containing water to an upper reservoir 104*a* containing hydrocarbon. For fluid to flow upwardly, pressure and potential energy P5 in FIG. 1A and P6 in FIG. 1B must overcome pressure and potential energy of respective pressures and potential energy P1-P4 in FIG. 1A and P1-P5 in FIG. 1B, from above. Accordingly, the direction of the arrows representing fluid flow in FIGS. 1A-B would be reversed, e.g., going upwardly. Additionally, impellers 206 in turbines 300 would have corresponding arrangements, e.g., fin deflection, such that upwardly flowing fluid would cause the impellers 206 to rotate accordingly.

Figure 2A:
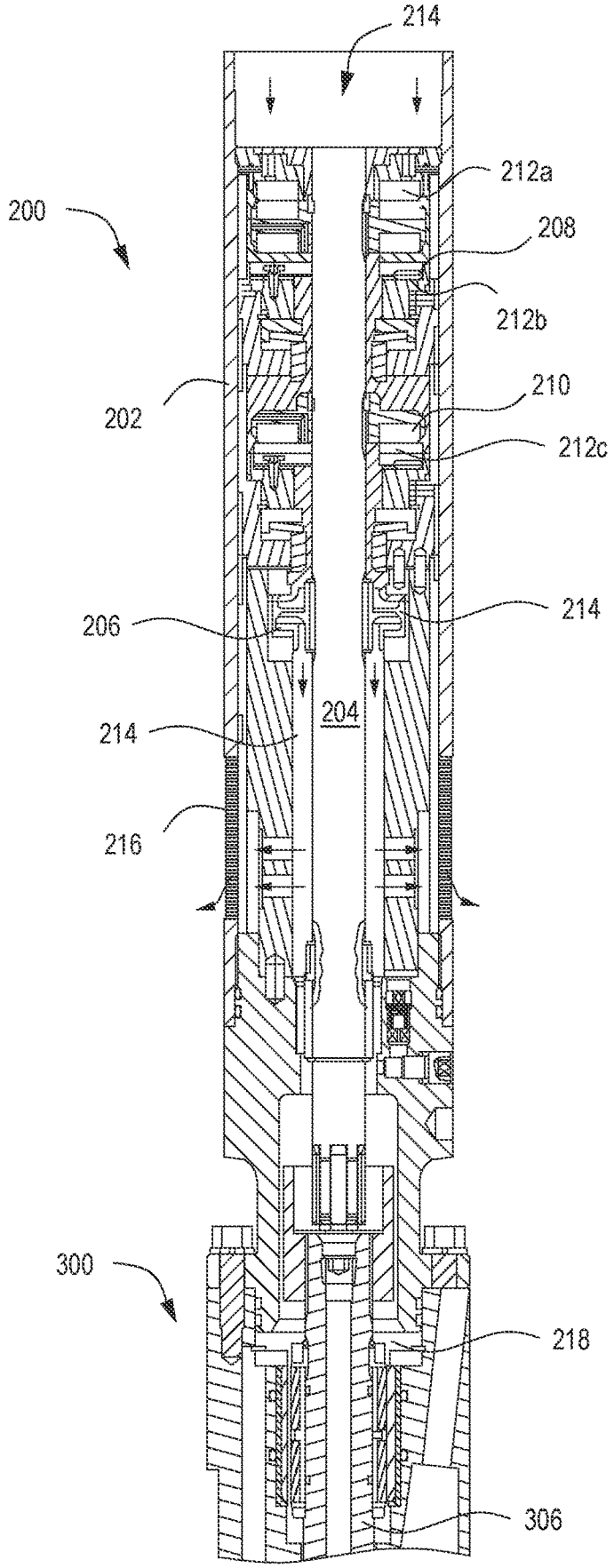
FIG. 2A is a cross-sectional side view of a structure that includes a turbine coupled to a generator.

FIG. 2A illustrates a cross-sectional side view of a turbine 200 coupled to a generator 300. The turbine 200 of FIG. 2A may be used with respective downhole wellbore systems 100 of FIGS. 1A-B. The turbine 200 may receive fluid flowing therethrough. The turbine 200 includes a turbine housing 202 having an inner surface and an outer surface. The turbine housing 202 surrounds internal components and assemblies. The inner surface of the turbine housing 202 defines a fluid reservoir 214 that is configured to receive fluid, e.g., from the upper reservoir 104*a* (see FIG. 1B). The fluid reservoir 214 has an upper end and a lower end. Arrows in FIG. 2A indicate fluid flow through the fluid reservoir 214 from the upper end towards the lower end of the turbine 200. The generator 300 is sealed from entry of external fluid that would exit from the turbine 200.

A body is disposed within and is coupled to the turbine housing 202. The body includes several internal components coupled together. An upper runner thrust bearing 212*a* may be positioned adjacent to an upper portion of a thrust runner 208. A lower runner thrust bearing 212*b* may be positioned adjacent to the lower portion of the thrust runner 208. A thrust bearing 212*c* is coupled to the inner surface of the turbine housing 202. When assembled and coupled to the turbine housing 202, the internal components form the body inside the turbine housing 202. The assembled components align to form a fluid reservoir 214 in the body. As indicated by arrows in FIG. 2A, fluid may flow through the fluid reservoir 214.

A shaft assembly is disposed within the internal assembly in the fluid reservoir 214. The shaft assembly includes a shaft 204, an impeller 206, a thrust runner 208, and a thrust pad 210 coupled to the outer surface of the shaft 204. The thrust runner 208 extends from the shaft 204 in-between the thrust bearing 212*a*, 212*b*. The thrust pad 210 is position adjacent to the thrust bearing 212*c*. Additionally, the thrust pad 210 extends from shaft 204 over the thrust bearing 212*c*. In some cases, the thrust runner 208 and the thrust pad 210 is not be in physical contact with the thrust bearing 212*a-c*. Thus, a clearance exists between the thrust runner 208 and the thrust bearings 212*a*, 212*b*. Also, a clearance exists between the thrust pad 210 and the thrust bearings 212*c*.

The impeller 206 is coupled to the shaft 204. Additionally, the impeller 206 is disposed in the fluid reservoir 214. Thus, as fluid flow through the fluid reservoir 214 and across the impeller 206, the flowing fluid would cause the impeller 206 to rotate. Accordingly, the shaft 204 would also be rotated. Moreover, a rotor of 306 of a generator 300 would be rotated as well because the shaft 204 is coupled to the rotor 306.

Rotation of the impeller 206 may produce an area of high pressure above the impeller 206 and an area of low pressure below the impeller 206, thereby creating differential pressure in the fluid reservoir 214. The differential pressure may cause fluid to flow in a path from the area of high pressure to the area of low pressure, as indicated by arrows in FIG. 2A.

Fluid flowing through the fluid reservoir 214 may exit the turbine housing 202 through one or more lower ports 216. The lower ports 216 extends through the inner surface and the outer surface of the turbine housing 202. During operations, the generator 300 may generate heat that radiates outwardly from the generator 300. Fluid exiting the turbine housing 202 may flow across the generator 300. The exiting fluid may absorb heat from the generator 300, carrying the heat away. Thus, fluid flowing out of the turbine 200 across the generator 300 may help cool the generator 300 during operations.

Figure 2C:
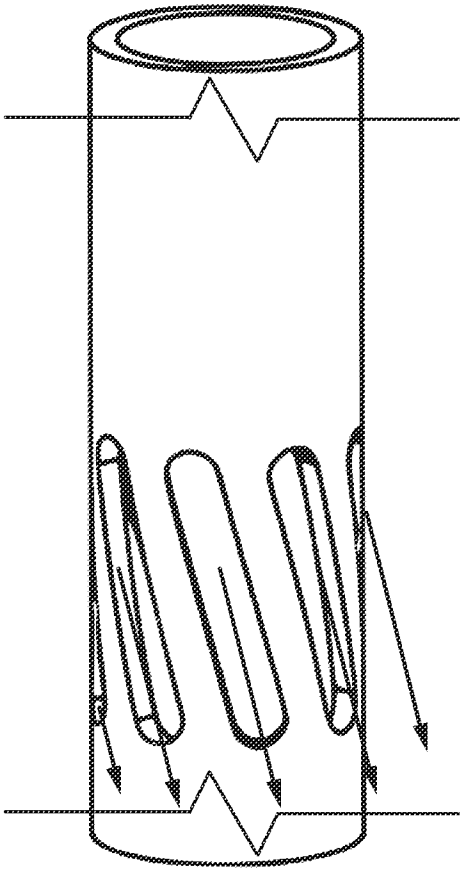
FIG. 2C is a perspective view of a portion of a turbine housing having lower ports at an angle relative to the central axis of the turbine housing.
Figure 2B:
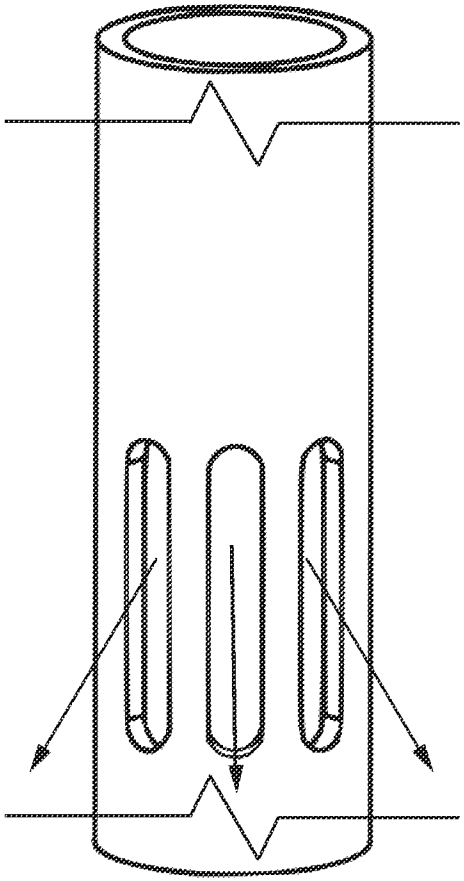
FIG. 2B is a perspective view of a portion of a turbine housing having elongated lower ports.

As shown in FIG. 2B, the lower ports 216 extends longitudinally, e.g., parallel to the central axis of the turbine housing 202, and disposed radially around the turbine housing 202. However, it should be understood that the lower ports 216 may be disposed in the outer housing 202 in various configurations. For example, each lower port 116 may have circular profiles. Alternatively, each lower port 216 may be elongated so as to have rectangular or oval profiles. In case of elongated ports, each lower port 116 may extend at an angle relative to the central axis of the turbine 200, as shown in FIG. 2C. Fluid exiting those angled ports may swirl, e.g., like a vortex, around the generator 300 as the fluid flows across the generator 300.

Figure 3:
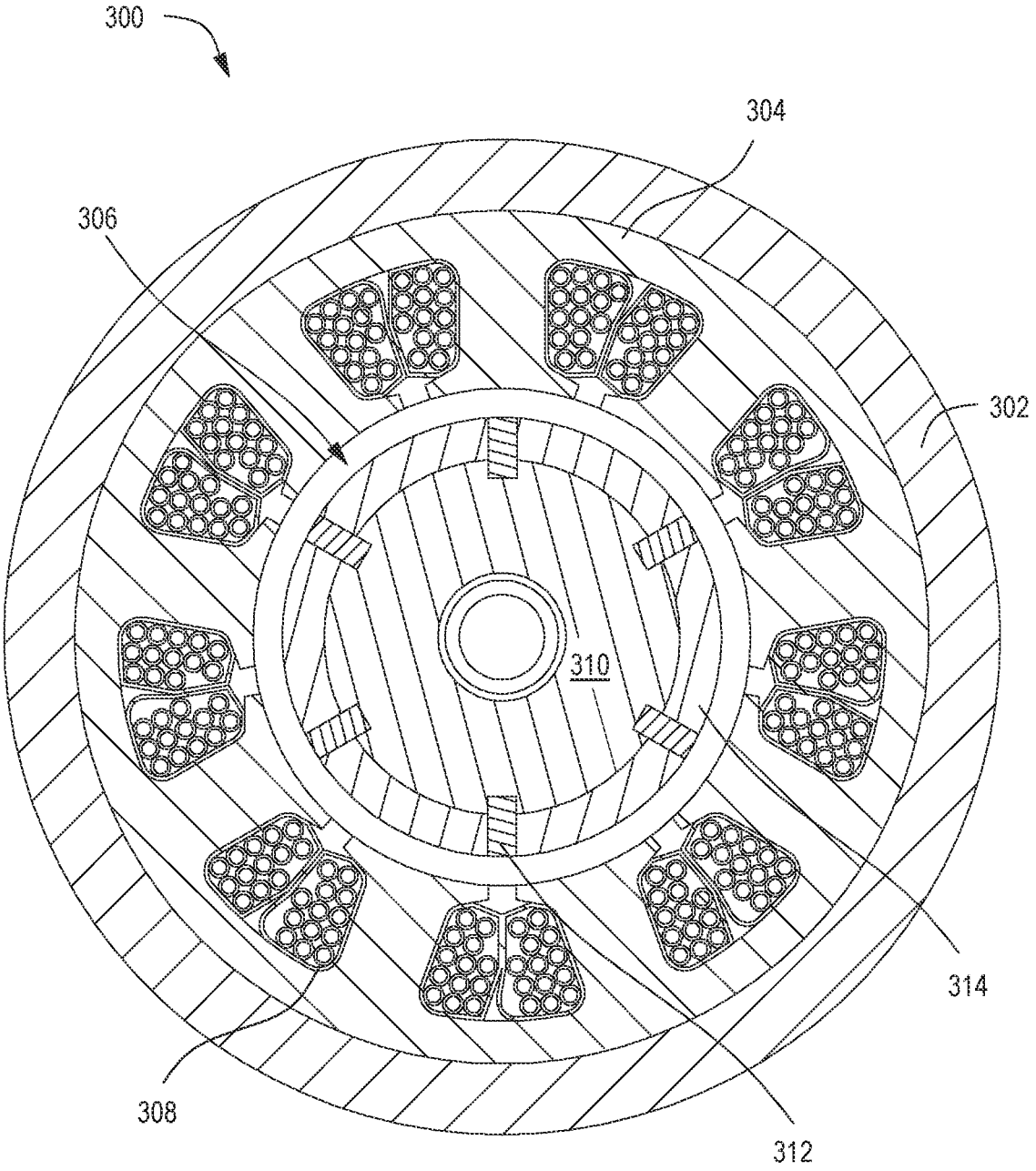
FIG. 3 is a cross-sectional top view of a structure that includes a generator.

FIG. 3 shows a cross-sectional top view of a generator 300. The generator 300 includes a generator housing 302, a stator 304, and a rotor 306. The stator 304 and the rotor 306 are disposed within the generator housing 302. Electrical wires 308 are wound around portions of the stator 304. The stator 304 has an outer surface and an inner surface. The inner surface defines a central aperture. A portion of the rotor 306 is disposed within the central aperture of the stator 304.

The rotor 306 includes a shaft 310 and a magnetic portion that includes one or more magnets 312. The shaft 310 is rotatably coupled to the generator housing 302 via bearings 218 (see FIG. 2A). Moreover, the shaft 310 of the rotor 306 may be coupled to a shaft 204 of a turbine 200 (see FIG. 2A).

The magnetic portion is coupled to a portion of the shaft 310. Additionally, the magnetic portion is disposed concentrically around the shaft 310, within to the stator 304. The magnetic portion includes an outer diameter. The outer diameter of the magnetic portion may be smaller than an inner diameter of the stator 304 so as to define an annular clearance between the rotor 306 and stator 304, as shown in FIG. 3. Lubricant is capable of flowing through the annular clearance.

The outer surface of the shaft 310 at the magnetic portion may have grooves 316 circumferentially disposed therein. The grooves 316 may be evenly spaced radially on the shaft 310. A magnet 312 may be disposed within each groove. The magnet 312 may be an arcuate wall disposed in each groove 316.

Preferably, pairs of adjacent magnets 312 on the shaft 310 are oriented to have corresponding ends that have opposing magnetic poles, e.g., negative and positive. Each magnet 312 may be coupled to the rotor 306 with adhesive. Furthermore, a non-magnetic sleeve 314 may be slidably coupled to the outer surface of the rotor 306 to secure the magnets 312 and provide additional stiffness to the rotor 306. The sleeve 314 defines an annular clearance between the outer diameter of the rotor 306 and the inner diameter of the stator 304. Preferably, the outer cylindrical wall of the sleeve 314 is smooth so that a consistent distance is maintained between the stator 304 and the rotor 306.

Figure 4:
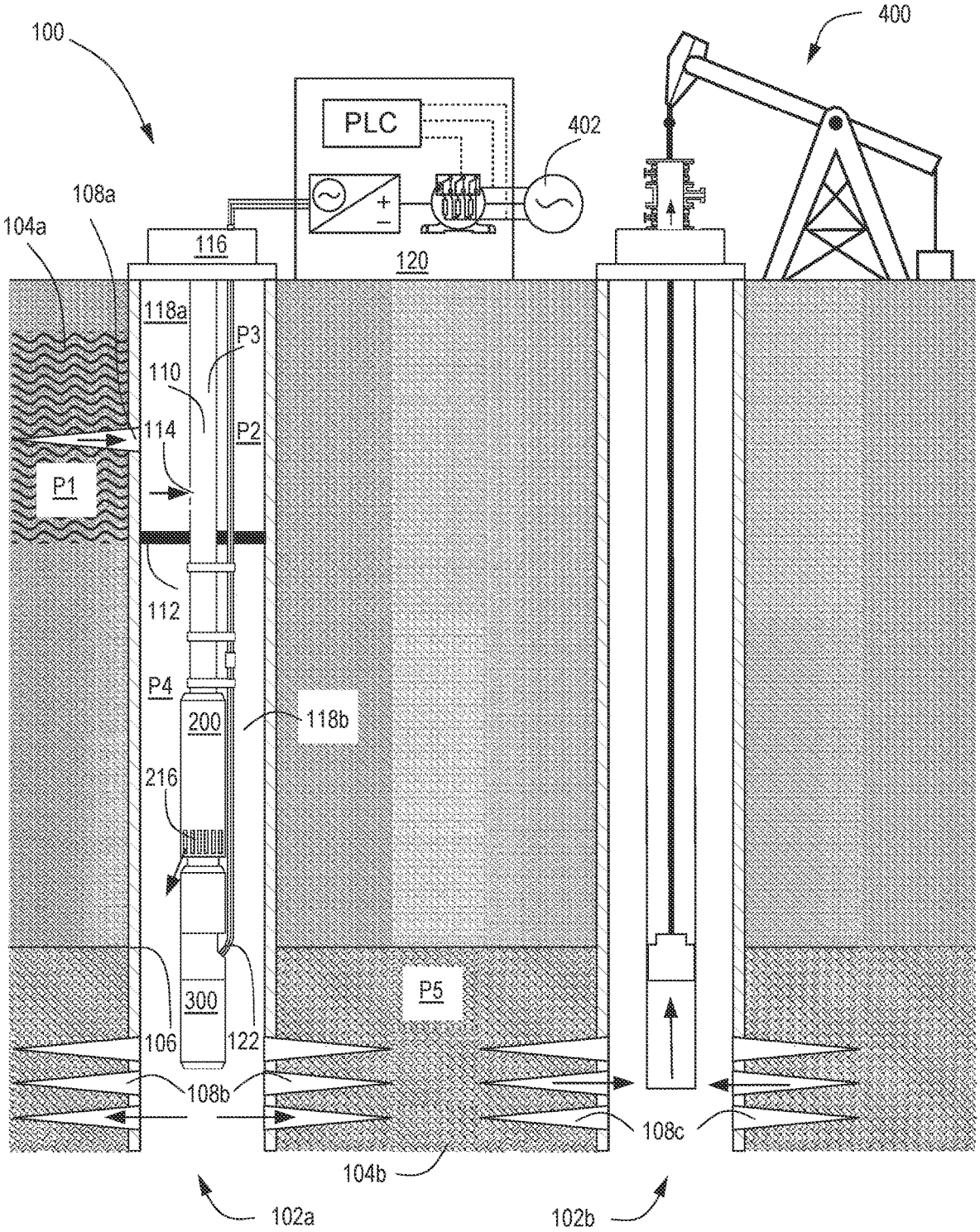
FIG. 4 is a schematic drawing that illustrates an example of a downhole wellbore system for generating electricity that is next to a wellbore that includes a pump assembly.

FIG. 4 illustrates a schematic of a downhole generator assembly 100 disposed in a first wellbore 102*a* and a pump assembly 400 having a portion disposed in a second wellbore 102*b*, wherein the pump assembly 400 is coupled to a remote power source 402, kilometers away from each other. The wellbores 102*a*, 102*b* extend underground across multiple zones of rock formation. The zones include a upper reservoir 104*a* and a lower reservoir 104*b*.

Portions of the wellbores 102*a*, 102*b* are each lined with and supported by respective hardened first casing 106*a* and second casing 106*b*. The casings 106*a*, 106*b* may be constructed from concrete and steel, among other materials. A first portion of the first casing 106*a* has one or more first perforations 108*a* disposed therethrough. The one or more first perforations 108*a* are adjacent the upper reservoir 104*a*. Thus, fluid, e.g., fresh water, from the upper reservoir 104*a* may enter through the one or more first perforations 108*a* into an upper annular space 118*a* of the first casing 106*a*.

When the one or more perforations 108*a* are unobstructed, hydrostatic pressure and potential energy in the upper reservoir 104*a* would naturally cause fluid therefrom to flow through the one or more perforations 108*a* into an upper annular space 118*a* of the first casing 106*a*, above a seal 112. The seal 112 may inhibit fluid from flowing past the seal 112, thereby separating the upper annular space 118*a* above the seal 112 from a lower annular space 118*b* below the seal 112.

Fluid in the upper annular space 118*a* may flow through an upper port 114 dispose in a second conduit 110 of the turbine 200. The upper port 114 is disposed above the seal 112. Fluid may flow below the seal 112 through the second conduit 110.

The process of electricity generation begins when fluid from the upper reservoir 104*a* flow into the second conduit 110 through the turbine 200 coupled to the second conduit 110. The flowing fluid causes one or more impellers 206 on a shaft 204 in a turbine 200 to rotate. The rotating shaft 204 also rotates a rotor 306 in a generator 300 that is coupled to the shaft 204 (see FIG. 2A). The rotating the rotor 306 would actuate the generator 300 to generate electricity (see FIG. 2A and FIG. 3).

Generated electricity may be transferred from the generator 300 to a surface power converting assembly 120 via one or more electric cables 122. The one or more electric cable 122 are electrically coupled to the generator 300 and the surface power converting assembly 120. The one or more electric cables 122 extend from the generator 300 up the wellbore 102 through the seal 112 to a wellhead 116. Additional electrical cables may electrically couple the wellhead 116 to the surface power converting assembly 120.

The surface power converting assembly 120 may receive and then transform the generated electricity into alternating current or direct current. Afterwards, the surface power converting assembly 120 may transmit the alternating current or direct current to the remote rechargeable power source 402 for storage.

Returning to the fluid flow through the turbine 200, because pressure and potential energy P4 in the lower annular space 118*b* is less than pressure and potential energy in the turbine 200, the fluid may exit the turbine 200 into the lower annular space 118*b* through one or more lower ports 216 in the turbine 200. Pressure and potential energy P5 in the lower reservoir 104*b* is less than pressure and potential energy P4 in the lower annular space 118*b*. Thus, the exited fluid may flow further down the wellbore 102*a* (below the seal 112) through one or more second perforations 108*b* disposed through a portion of the first casing 106*a*. Fluid may exit the first wellbore 102*a* into adjacent rock formation through the one or more second perforations 108*b*. The adjacent rock formation may contain the lower reservoir 104*b*.

Fluid, e.g., hydrocarbon and/or fresh water, from the lower reservoir 104*b* may be extracted from the lower reservoir 104*b* into the second wellbore 102*b* through one or more third perforations 108*c* of the second casing 106*b*. The pump assembly 400 disposed in the second wellbore 102*b* may be actuated to extract to surface fluid in the second wellbore 102*b*.

Actuation of the pump assembly 400 may be powered by electricity stored in the remote rechargeable power source 402.

Figure 5:
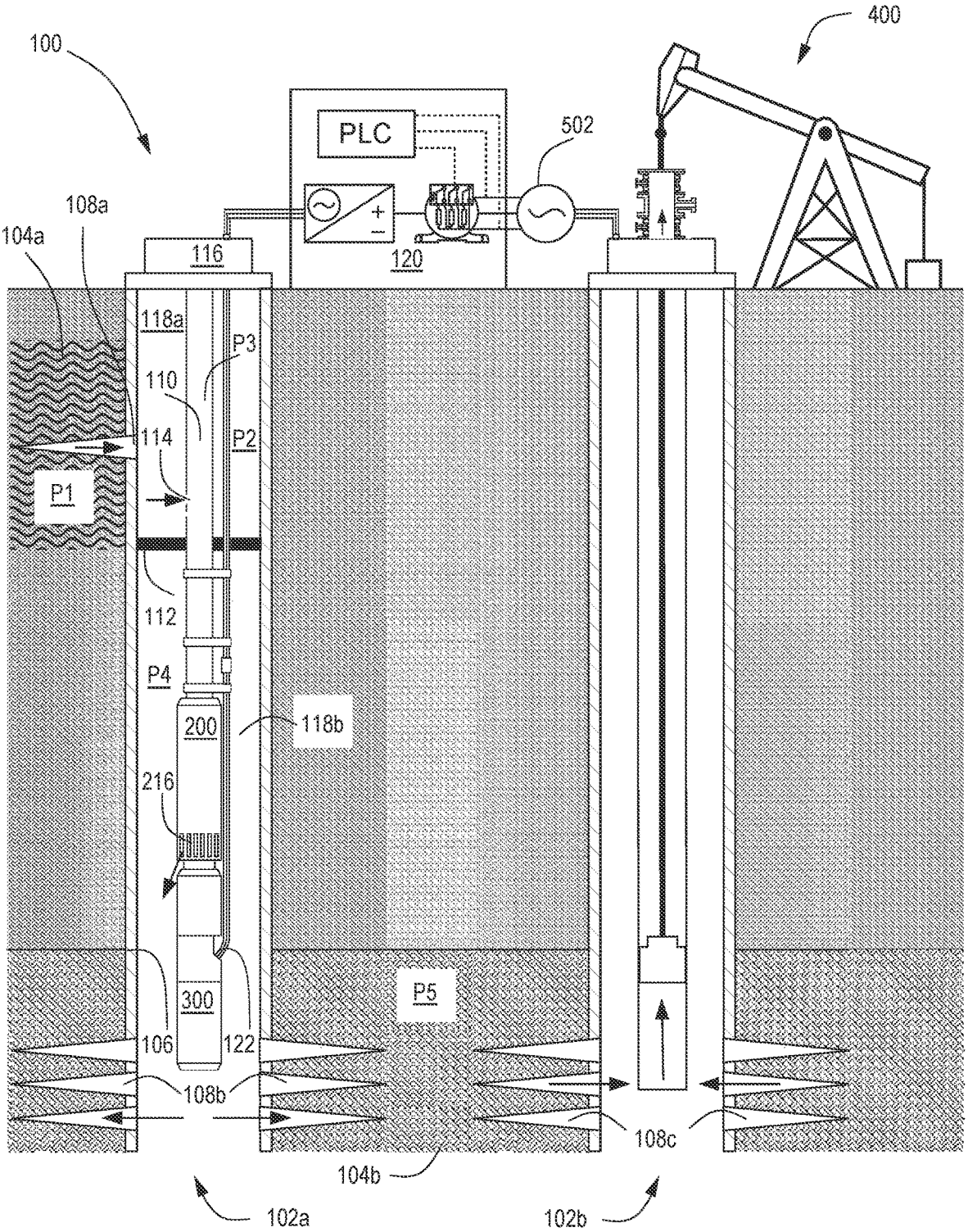
FIG. 5 is a schematic drawing that illustrates an example of a downhole wellbore system for generating electricity that is next to a wellbore that includes a pump assembly, in which the pump assembly in the second wellbore is powered at least in part by electricity generated by the downhole wellbore system.

FIG. 5 illustrates a schematic of a downhole generator assembly 100 disposed in a first wellbore 102*a* and a pump assembly 400 having a portion disposed in a second wellbore 102*b*, wherein the pump assembly 400 is coupled to a local power source 502, meters away from each other. The components and method of electricity generation relative FIG. 5 are similar to those discussed above for FIG. 4. However, referring to FIG. 5, electricity generated from the downhole generator assembly 100 may be stored, e.g., via batteries and/or capacitors, in the local power source 502. Accordingly, actuation of the pump assembly 400 may be powered by electricity stored in the local rechargeable power source 402*b*.

What is claimed as the invention is:

1. A downhole wellbore system for generating electricity using reservoir fluid, the downhole wellbore system comprising:

a first conduit in a wellbore that has an interior and comprises:

one or more upper perforations capable of providing for the passage of reservoir fluid therethrough; and one or more lower perforations capable of providing for the passage of reservoir fluid therethrough;

a barrier disposed in the interior of the first conduit below the one or more upper perforations and above the lower perforation one or more lower perforations and capable of inhibiting reservoir fluid from flowing past the barrier;

a second conduit disposed inside the first conduit, the second conduit having an interior and having one or more upper ports disposed above the barrier;

a cylindrical housing coupled to the second conduit, wherein the housing has a cylindrical wall, an interior portion, an upper end opening, and a lower end opening;

a third conduit extending from the lower end opening of the cylindrical housing into the barrier, wherein the third conduit is removably coupled to the barrier;

an impeller disposed in the housing;

a generator disposed in the interior of the cylindrical housing, the generator comprising a rotor coupled to the impeller; and a cable capable of transmitting electricity upward through the wellbore to the surface.

2. The downhole wellbore system of claim 1, wherein the second conduit extends into the upper end opening of the cylindrical housing end.

3. The downhole wellbore system of claim 1, wherein the third conduit extends through the barrier.

4. The downhole wellbore system of claim 1, wherein the third conduit has an outer diameter smaller than an outer diameter of the housing.

5. The downhole wellbore system of claim 1, wherein the third conduit has an outer diameter smaller than an inner diameter of the barrier.

6. A downhole wellbore system for generating electricity using reservoir fluid, the downhole wellbore system comprising:

a first conduit in a wellbore that has an interior and comprises:

one or more upper perforations capable of providing for the passage of reservoir fluid therethrough; and one or more lower perforations capable of providing for the passage of reservoir fluid therethrough;

a barrier disposed in the interior of the first conduit below the one or more upper perforations and above the one or more lower perforations and capable of inhibiting reservoir fluid from flowing past the barrier;

a second conduit disposed inside the first conduit, the second conduit having an interior and having one or more upper ports disposed above the barrier;

a cylindrical housing coupled to the second conduit, wherein the housing has a cylindrical wall, an interior portion, an upper end opening, and a lower end opening;

a third conduit extending from the lower end opening of the cylindrical housing into the barrier, wherein the third conduit is capable of being removed from the barrier while the barrier is coupled to the first conduit;

an impeller disposed in the housing;

a generator disposed in the interior of the cylindrical housing, the generator comprising a rotor coupled to the impeller; and a cable capable of transmitting electricity upward through the wellbore to the surface.

7. A downhole wellbore system for generating electricity using reservoir fluid, the downhole wellbore system comprising:

a first conduit in a wellbore that has an interior and comprises:

one or more upper perforations capable of providing for the passage of reservoir fluid therethrough; and one or more lower perforations capable of providing for the passage of reservoir fluid therethrough;

a barrier disposed in the interior of the first conduit below the one or more upper perforations and above the one or more lower perforations and capable of inhibiting reservoir fluid from flowing past the barrier;

a second conduit disposed inside the first conduit, the second conduit having an interior and having one or more upper ports disposed above the barrier;

a cylindrical housing coupled to the second conduit, wherein the housing has a cylindrical wall, an interior portion, an upper end opening, and a lower end opening;

a third conduit extending from the lower end opening of the cylindrical housing into the barrier, wherein the third conduit is capable of being pushed through the barrier while the barrier is coupled to the first conduit;

a generator disposed in the interior of the cylindrical housing, the generator comprising a rotor coupled to the impeller; and a cable capable of transmitting electricity upward through the wellbore to the surface.

* * * * *